US009827455B1

(12) United States Patent
Tapia Negrete

(10) Patent No.: US 9,827,455 B1
(45) Date of Patent: Nov. 28, 2017

(54) SPRINKLER ASSEMBLIES

(71) Applicant: Tyco Fire Products LP, Lansdale, PA (US)

(72) Inventor: Jesus Alonso Tapia Negrete, Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 200 days.

(21) Appl. No.: 14/522,184

(22) Filed: Oct. 23, 2014

Related U.S. Application Data

(60) Provisional application No. 61/894,865, filed on Oct. 23, 2013.

(51) Int. Cl.

| | |
|---|---|
| ***A62C 37/11*** | (2006.01) |
| ***B05B 1/26*** | (2006.01) |
| ***A62C 31/02*** | (2006.01) |
| ***A62C 37/12*** | (2006.01) |
| ***A62C 37/14*** | (2006.01) |
| ***A62C 37/16*** | (2006.01) |

(52) U.S. Cl.
CPC ..... *A62C 37/11* (2013.01); *A62C 31/02* (2013.01); *A62C 37/12* (2013.01); *A62C 37/14* (2013.01); *A62C 37/16* (2013.01); *B05B 1/265* (2013.01); *B05B 1/267* (2013.01)

(58) Field of Classification Search
CPC ..... A62C 37/11; A62C 37/12; A62C 37/14; A62C 37/16; A62C 31/02; B05B 1/265; B05B 1/267
USPC ..... 239/498, 504, 522, 524; 169/37–41, 90
See application file for complete search history.

(56) References Cited

U.S. PATENT DOCUMENTS

| | | | | |
|---|---|---|---|---|
| 4,987,957 | A * | 1/1991 | Galaszewski | A62C 37/12 169/37 |
| 5,392,993 | A * | 2/1995 | Fischer | A62C 31/02 169/38 |
| 5,865,256 | A * | 2/1999 | Pounder | A62C 37/14 169/37 |
| 6,446,732 | B1 * | 9/2002 | Polan | A62C 31/02 169/37 |
| 9,457,213 | B2 | 10/2016 | Miller et al. | |
| 2001/0042795 | A1 * | 11/2001 | Franson | A62C 37/14 239/214 |

(Continued)

OTHER PUBLICATIONS

IFW, U.S. Appl. No. 61/894,865, filed Oct. 23, 2013, 46 pages.

*Primary Examiner* — Alexander Valvis
(74) *Attorney, Agent, or Firm* — Perkins Coie LLP

(57) ABSTRACT

A sprinkler assembly including an outlet frame defining a sprinkler longitudinal axis and an outlet with a pair of frame arms defining a first plane. A deflector is coupled to the frame arms with the deflector having an upper surface and a lower surface orthogonal to the longitudinal sprinkler axis. The deflector includes a plurality of tines defining a plurality of slots between the tines. The tines include a terminal portion having a terminal edge. A first symmetric tine is aligned with the pair of frame arms with the first symmetric tine being symmetric about the first plane and a second symmetric tine is symmetric about a second plane perpendicular to the first plane. A pair of asymmetric tines is disposed about and adjacent the first symmetric tine with the terminal edge of the first symmetric tine closer to the second plane than the terminal edges of the asymmetric tines.

15 Claims, 6 Drawing Sheets

(56) References Cited

U.S. PATENT DOCUMENTS

| | | | | |
|---|---|---|---|---|
| 2008/0011491 | A1* | 1/2008 | Thau | A62C 31/02<br>169/37 |
| 2009/0126950 | A1* | 5/2009 | Rogers | A62C 35/68<br>169/46 |

* cited by examiner

SPRINKLER ASSEMBLIES

PRIORITY CLAIM & INCORPORATION BY REFERENCE

This application claims the benefit of priority to U.S. Provisional Patent Application No. 61/894,865 filed Oct. 23, 2013, which is incorporated by reference in its entirety.

BACKGROUND OF THE INVENTION

Automatic sprinkler systems are some of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. The effectiveness of a sprinkler is dependent upon the sprinkler consistently delivering an expected flow rate of fluid from its outlet for a given pressure at its inlet. The discharge coefficient or K-factor of a sprinkler allows for an approximation of flow rate to be expected from an outlet of a sprinkler based on the square root of the pressure of fluid fed into the inlet of the sprinkler. As used herein, the K-factor is defined as a constant representing the sprinkler discharge coefficient, that is quantified by the flow of fluid in gallons per minute (GPM) from the sprinkler outlet divided by the square root of the pressure of the flow of fluid fed into the inlet of the sprinkler passageway in pounds per square inch (PSI). The K-factor is expressed as GPM/$(PSI)^{1/2}$ can provide for a rated or nominal K-factor or rated discharge coefficient of a sprinkler as a mean value over a K-factor range. For example, for a K-factor greater than 11, the following nominal K-factors (with the K-factor range shown in parenthesis) can be expressed as: (i) 14.0 (13.5-14.5) GPM/$(PSI)^{1/2}$; (ii) 16.8 (16.0-17.6) GPM/$(PSI)^{1/2}$; (iii) 19.6 (18.6-20.6) GPM/$(PSI)^{1/2}$; (iv) 22.4 (21.3-23.5) GPM/$(PSI)^{1/2}$; (v) 25.2 (23.9-26.5) GPM/$(PSI)^{1/2}$; and (vi) 28.0 (26.6-29.4) GPM/$(PSI)^{1/2}$; 33.6 (32.7-34.5) GPM/$(PSI)^{1/2}$; 36.5 (34.9-38.1) GPM/$(PSI)^{1/2}$ or higher.

The fluid supply for a sprinkler system may include, for example, an underground water main that enters the building to supply a vertical riser. At the top of a vertical riser, an array of pipes extends throughout the fire compartment in the building. In the piping distribution network atop the riser includes branch lines that carry the pressurized supply fluid to the sprinklers.

An automatic sprinkler may be configured for addressing a fire in a particular mode such as for example, control mode or suppression mode. Fire suppression is defined in the industry accepted standard, the National Fire Protection Association (NFPA) standard entitled, "NFPA 13: Standards for the Installation of Sprinkler Systems" (2010 ed.) ("NFPA 13") and its updated edition NFPA 13 (2013 ed.), Section 3.3.10 as "[s]harply reducing the heat release rate of a fire and preventing its regrowth by means of direct and sufficient application of water through the fire plume to the burning fuel surface." A sprinkler that provides for fire suppression is a suppression mode sprinkler. A suppression mode sprinkler can be "listed" as a sprinkler that has been tested, verified and published in a list by an industry accepted organization, such as for example, FM Global ("FM") and Underwriters Laboratories ("UL") as a sprinkler being suitable for the specified purpose of fire suppression.

Early Suppression Fast Response (ESFR) is defined under NFPA 13, Section 3.6.4.2 as a sprinkler having a thermal sensitivity, i.e., response time index ("RTI") of 50 $meter^{1/2}second^{1/2}$ ("$m^{1/2}sec^{1/2}$") or less and "listed" for its capability to provide fire suppression of specific high-challenge fire challenges. The "RTI" is a measure of thermal sensitivity and is related to the thermal inertia of a heat responsive element of a sprinkler. While ESFR sprinklers can be defined by the RTI of the sprinkler and its performance under the test standards, it should be understood that "suppression" mode sprinklers are not necessarily limited to ESFR sprinklers or sprinklers having an RTI of 50 or less. Accordingly, suppression mode sprinklers satisfying standardized test and/or other suppression criteria may have a thermally sensitive trigger having an RTI of ordinary or standard response sprinklers, i.e., RTI of 80 or greater.

According to the description in U.S. Pat. No. 5,829,532, when "fast response" was being investigated in the 1980's, "standard sprinklers" were found to have an RTI of more than 100 $m^{1/2}sec^{1/2}$ or more typically up to nearly 400 $m^{1/2}sec^{1/2}$; and for sprinklers that were found to thermally respond faster than standard sprinklers, the RTI was found to be less than 100 $m^{1/2}sec^{1/2}$. Currently under NFPA 13, Section 3.6.1, a "fast response" sprinkler is defined as a sprinkler having a thermal element with an RTI of 50 $m^{1/2}sec^{1/2}$ or less; and a "standard response" sprinkler is defined as a sprinkler having a thermal element with an RTI of 80 $m^{1/2}sec^{1/2}$ or more. Historically, a class of "special" faster operating sprinkler had been recognized having RTIs between 80 and 50 $m^{1/2}sec^{1/2}$. For one type of fast-response sprinkler, the early suppression fast response ("ESFR") sprinkler, the thermal trigger has an RTI of 50 $m^{1/2}sec^{1/2}$ or less, more particularly 40 $m^{1/2}sec^{1/2}$ and even more particularly 19 to 36 $m^{1/2}sec^{1/2}$. It was once believed for fast-growing industrial fires of the type to be protected by ESFR sprinklers, that the RTI and the temperature rating together ensured adequate fast sprinkler response. Accordingly, some ESFR sprinklers include a trigger having an RTI of less than 40 $m^{1/2}sec^{1/2}$ and a temperature rating of 165° F. or 214° F. However, as described in U.S. Pat. No. 5,829,532 one embodiment of a sprinkler provided suppression of a high challenge fire with an trigger having an RTI of less than 100 $m^{1/2}sec^{1/2}$. Accordingly, as used herein, fast-response triggers can be characterized by RTIs of less than 100 $m^{1/2}sec^{1/2}$; 80 $m^{1/2}sec^{1/2}$ or less; 50 $m^{1/2}sec^{1/2}$ or less; 40 or less $m^{1/2}sec^{1/2}$ or ranging between 19 to 36 $m^{1/2}sec^{1/2}$.

DISCLOSURE OF THE INVENTION

Preferred embodiments of a sprinkler assembly are provided. One preferred embodiment of a sprinkler assembly includes an outlet frame having an inlet, internal passageway that defines a sprinkler longitudinal axis and an outlet defining a nominal K-factor. The frame preferably includes a pair of frame arms diametrically opposed about the outlet to define a first plane with the arms and longitudinal axis being disposed in the first plane. A deflector is coupled to the frame arms so as to be preferably axially spaced from the outlet. The deflector is a preferably planar member having an upper surface, and a lower surface opposite the upper surface to define a uniform thickness of the planar member with the upper and lower surfaces orthogonal to the longitudinal sprinkler axis. The preferred deflector includes a central portion and a peripheral portion with the peripheral portion including a plurality of tines disposed about the central portion to define a plurality of slots between the tines. Each of the plurality tines preferably includes a base extending from the central portion, a body extending from the base, and a terminal portion extending from the body. The terminal portion preferably includes a terminal edge radially spaced from the base. The preferred plurality of tines include a first symmetric tine aligned with the pair of frame arms with the first symmetric tine being symmetric about the first plane; a second symmetric tine orthogonal to the first symmetric tine with the second tine symmetric about a second plane. The second plane is preferably perpendicular to the first plane so as to define an intersection of the first and second planes disposed along the longitudinal sprinkler axis. A first pair of asymmetric tines is preferably disposed about and adjacent the first symmetric tine with the terminal edge of the first symmetric tine being preferably closer to the second plane than the terminal edges of each of the first pair of asymmetric tines.

Another preferred embodiment of a sprinkler assembly includes an outlet frame having an inlet, internal passageway defining a sprinkler longitudinal axis, and an outlet to define a nominal K-factor. The frame preferably includes a pair of frame arms diametrically opposed about the outlet to define a first plane with the arms with the longitudinal axis being disposed in the first plane. A deflector is preferably coupled to the frame arms so as to be axially spaced from the outlet. The deflector is preferably a planar member having an upper surface, and a lower surface opposite the upper surface to define a uniform thickness of the planar member with the upper and lower surfaces orthogonal to the longitudinal sprinkler axis. The deflector includes a central portion and a peripheral portion with the peripheral portion preferably including a plurality of tines disposed about the central portion to define a plurality of slots between the tines. Each of the preferred plurality tines includes a base extending from the central portion, a body extending from the base, and a terminal portion extending from the body with the terminal portion including a terminal edge radially spaced from the base. The plurality of tines preferably includes a first pair T-shaped tines disposed about the central portion and aligned with the pair of frame arms; and a second pair of T-shaped tines disposed about the central portion and orthogonal to the first pair of symmetric tines and disposed along a second plane that is perpendicular to the first plane so as to define an intersection of the first and second planes disposed along the longitudinal sprinkler axis.

In another preferred embodiment of a sprinkler assembly, the assembly includes an outlet frame having an inlet, internal passageway defining a sprinkler longitudinal axis, and an outlet to defining a nominal K-factor. The frame preferably includes a boss axially spaced from the outlet and a pair of frame arms diametrically opposed about the outlet to define a first plane with the arms and longitudinal axis being disposed in the first plane and with the pair of frame arms extending distally and converging at the boss. A deflector is preferably coupled to the frame arms so as to be axially spaced from the outlet. The preferred deflector is a planar member having an upper surface, and a lower surface opposite the upper surface to define a uniform thickness of the planar member with the upper and lower surfaces being orthogonal to the longitudinal sprinkler axis. The deflector includes a central portion and a peripheral portion with the peripheral portion preferably including a plurality of tines disposed about the central portion to define a plurality of slots between the tines. Each of the plurality tines preferably includes a base extending from the central portion, a body extending from the base, and a terminal portion extending from the body with the terminal portion including a terminal edge radially spaced from the base. The plurality of tines preferably includes a first pair of T-shaped tines disposed about the central portion and aligned with the pair of frame arms, the first pair symmetric tines being symmetric about the first plane; and a second pair of T-shaped tines disposed about the central portion and orthogonal to the first pair of symmetric tines, the second pair of symmetric tines being symmetric about the a second plane that is perpendicular to the first plane so as to define an intersection of the first and second planes disposed along the longitudinal sprinkler axis. A first pair of asymmetric tines is preferably disposed about the central portion and angularly adjacent the first pair of T-shaped tines; and a second pair of asymmetric tines is preferably disposed about the central portion and angularly adjacent the second pair of T-shaped tines. The first and second asymmetric tines are angularly disposed between the first and second pairs of T-shaped tines adjacent one another so as to define a plurality of slots therebetween. The preferred deflector assembly includes any one of the following: (i) the terminal edges of the first pair of T-shaped tines being closer to the second plane than the terminal edges of the first pair of asymmetric tines; (ii) a portion of the body of the second pair of T-shaped tines between the base and the terminal portion defining a variable width; and (iii) the plurality of slots including a slot with a radial innermost portion located axially beneath the boss.

BRIEF DESCRIPTIONS OF THE DRAWINGS

The accompanying drawings, which are incorporated herein and constitute part of this specification, illustrate exemplary embodiments of the invention, and, together with the general description given above and the detailed description and attachments given below, serve to explain the features of the invention.

DETAILED DESCRIPTION OF THE PREFERRED EMBODIMENTS

Figure 1:
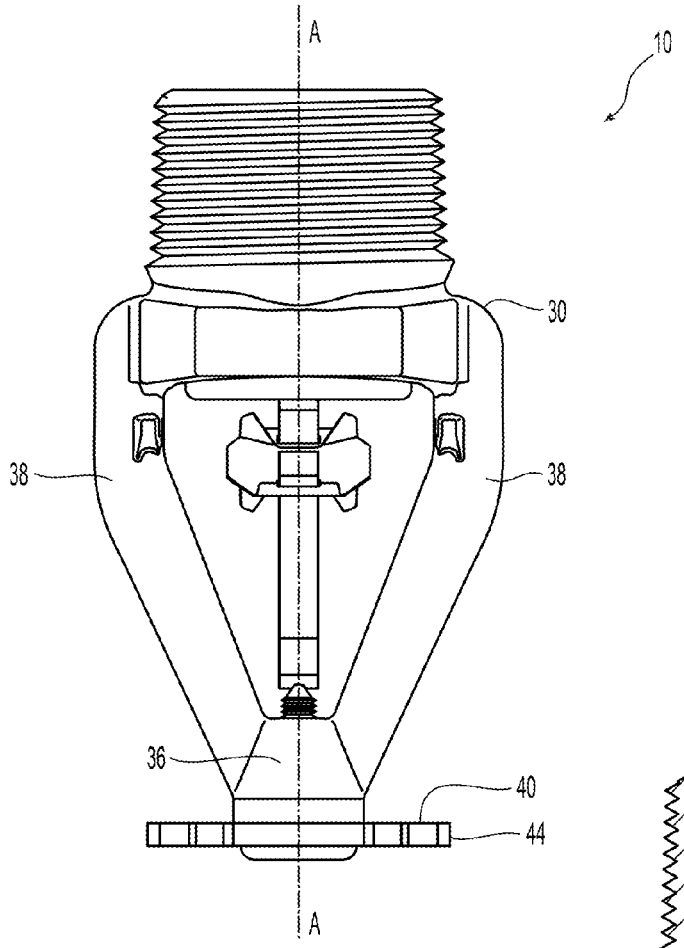
FIG. 1 is an illustrative embodiment of a preferred sprinkler assembly.

Shown in FIGS. 1, 2, 3, 3A-3C is a preferred embodiment of sprinkler assembly or sprinkler 10 includes an outlet frame 30 defining an internal passageway 32 extending along a central longitudinal sprinkler axis A-A between a proximal threaded inlet end 12 and a distal outlet end 14. In a preferred embodiment of the sprinkler, the sprinkler outlet frame 30 and outlet define a preferred discharge coefficient or K-factor defining a nominal K-factor of greater than 22 GPM/$(PSI)^{1/2}$ and is more preferably any one of a nominal factor of 25.2 GPM/$(PSI)^{1/2}$; 28.0 GPM/$(PSI)^{1/2}$; or 33.6 GPM/$(PSI)^{1/2}$; or higher. However, it should be understood that the sprinkler 10 can be assembled with a frame defining a K-factor of 22 GPM/$(PSI)^{1/2}$ or lower, such as for example 14.0 GPM/$(PSI)^{1/2}$; 16.8 GPM/$(PSI)^{1/2}$; 19.6 GPM/$(PSI)^{1/2}$.

Figure 2:
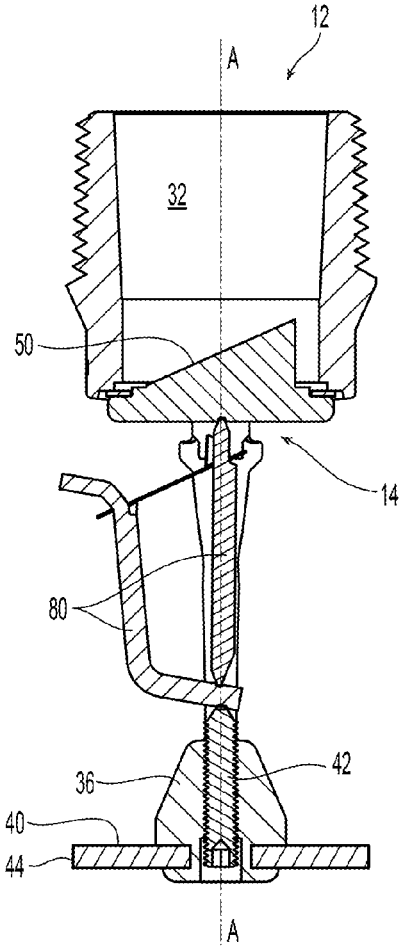
FIG. 2 is a cross-sectional view of the sprinkler assembly of FIG. 1.

The distal end of the outlet frame 30 can include at least one frame arm 38 and more preferably a pair of frame arms 38 that is coupled to a fluid deflecting structure 40. Preferably, the outlet frame 30 and frame arm 38 are formed as a unitary member. The outlet frame 30, frame arm 38, and fluid deflecting structure 40 can be made from rough or fine casting, stamping and, if desired, machined. Referring to FIG. 2, the fluid deflecting structure 40 can include an adjustment screw 42 and a planar surface member 44 coupled to the frame arm 38 and preferably fixed at a spaced axial distance from the outlet frame 30. Accordingly, as shown, the preferred outlet frame 30 and deflecting structure 40 provide for a pendent sprinkler configuration. The exemplary planar surface member 44 is configured to deflect the fluid flow to form an appropriate spray pattern, and is more preferably configured as the deflector 100 described below. The adjustment screw 42 is provided with external threads that can be used to adjust an axial spacing between an inner seal assembly 50 and a thermal trigger 80 such that that the thermal trigger 80 supports the inner seal assembly in the unactuated state of the sprinkler of FIG. 2. In one preferred embodiment, the trigger 80 preferably defines a thermal sensitivity or RTI of less than 100 $m^{1/2}sec^{1/2}$; 80 $m^{1/2}sec^{1/2}$ or less; 50 $m^{1/2}sec^{1/2}$ or less; 40 or less $m^{1/2}sec^{1/2}$ or ranging between 19 to 36 $m^{1/2}sec^{1/2}$. More preferably, when the sprinkler 10 is configured as an ESFR sprinkler, the trigger 80 preferably defines an RTI ranging between 19 and 36 $meter^{1/2}second^{1/2}$.

Figure 4A:
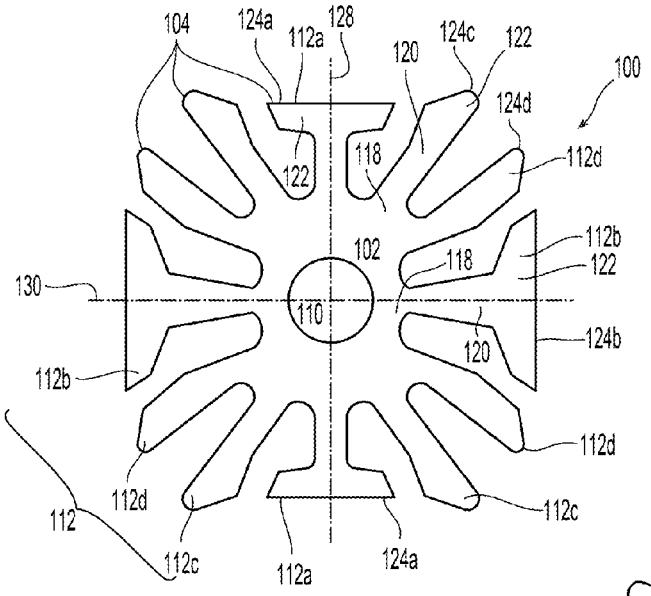
FIGS. 4A-4C are plan views of a preferred embodiment of a deflector for use in the sprinkler assembly of FIG. 1.
Figure 4B:
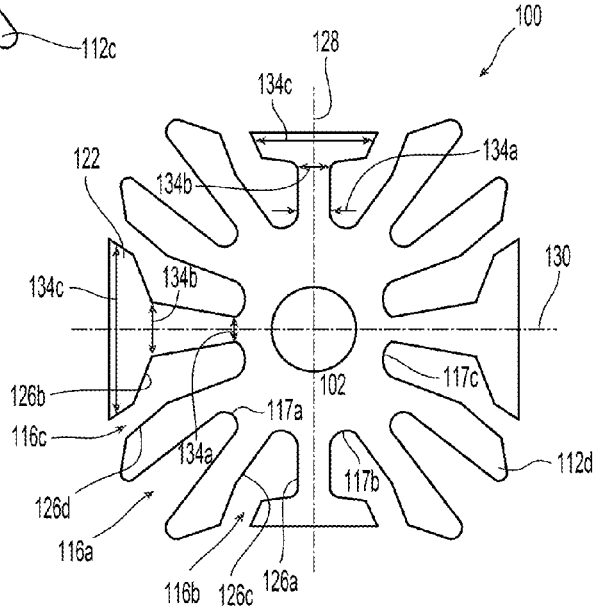
Figure 4C:
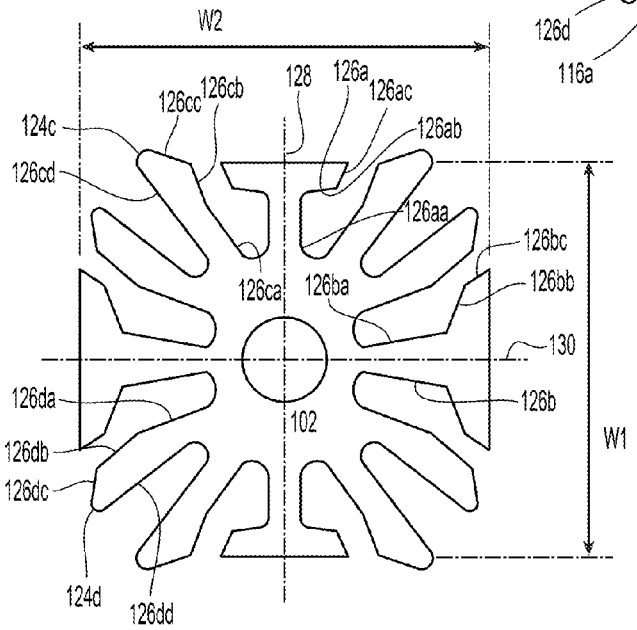
Figure 5A:
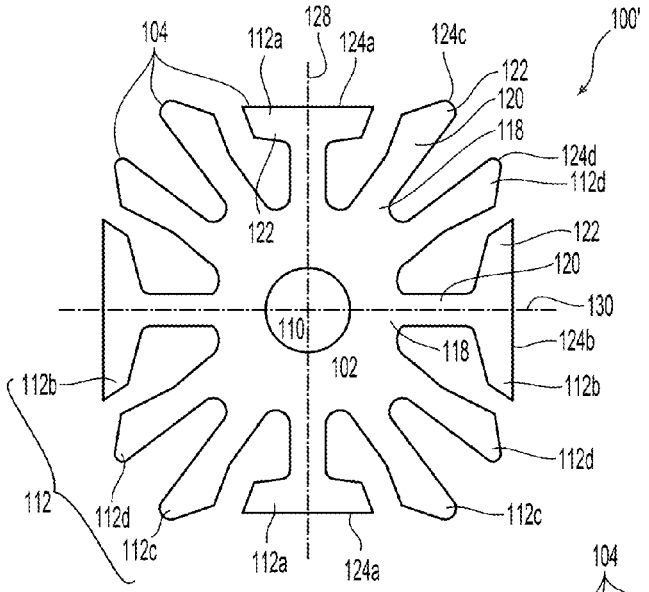
FIGS. 5A-5C are plan views of the preferred embodiment of the deflector used in the sprinkler assembly of FIG. 3.
Figure 5B:
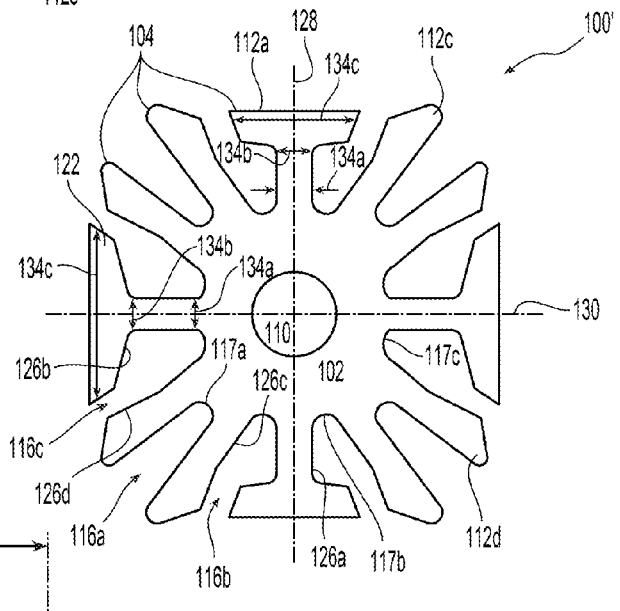
Figure 5C:
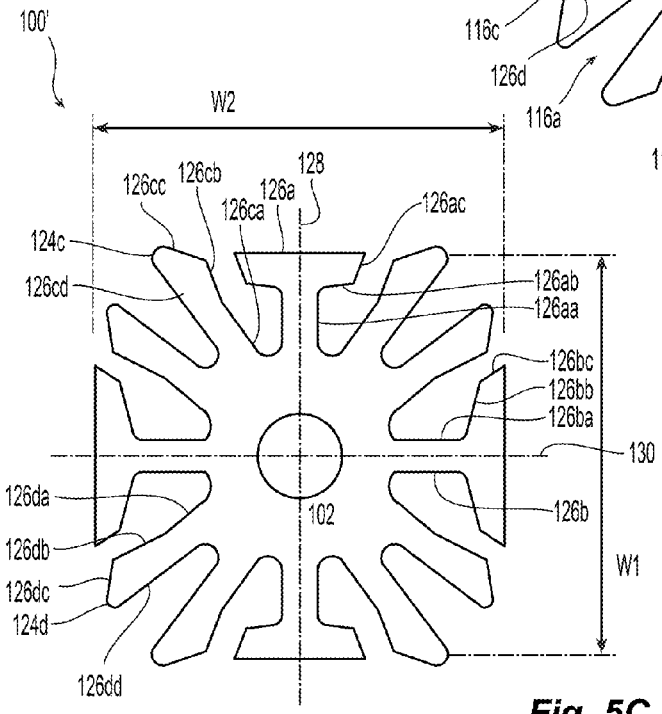

The aforementioned and described sprinkler assemblies can be used with a planar surface member 44 disposed orthogonal to the sprinkler axis A-A. As illustrated in FIGS. 4A-4C; 5A-5C, the preferred planar surface member 44 is a deflector 100, 100' formed from a plate of uniform plate thickness. Except for where expressly provided, the deflectors 100, 100' have similar features. The deflector 100 preferably has a central portion 102 and a peripheral portion 104 disposed about the central portion 102. The central portion 102 includes a mounting hole 110 that is centered on and about the sprinkler axis A-A and sized and positioned to engage the frame arm 38 to hold the deflector 100 at a fixed position and orientation relative to the frame arm 38. Once installed, the deflector 100, 100' presents an upper surface 100*a* to the outlet 14 and a lower surface 100*b* axially opposite the upper surface 100*a*. Each of the upper surface 100*a* and lower surface 100*b* are orthogonal to the sprinkler axis A-A as seen, for example, in FIG. 3A. The axial spacing between the upper and lower surfaces 100*a*, 100*b* define the thickness t of the deflector 100 and more preferably define a uniform thickness of about 0.125 inch. The peripheral portion 104 of the deflector 100 is preferably defined by a plurality of repeating tines 112 disposed about the central portion 102 of the deflector 100 with spacing between adjacent tines 112 to define the deflector slots 116. Each tine 112 preferably defines a base 118 extending from and preferably continuous with the central portion 102, a body 120 extending radially away from and preferably continuous with the base 118, and a terminal portion 122 extending from and preferably continuous with the body 120 that ultimately ends at a terminal end surface 124 of the tine that is radially spaced from the base 118. In a preferred embodiment, the plurality of tines 112 include twelve tines circumferentially spaced about the sprinkler axis A-A so as to define the plurality of deflector slots 116 therebetween.

Figure 3:
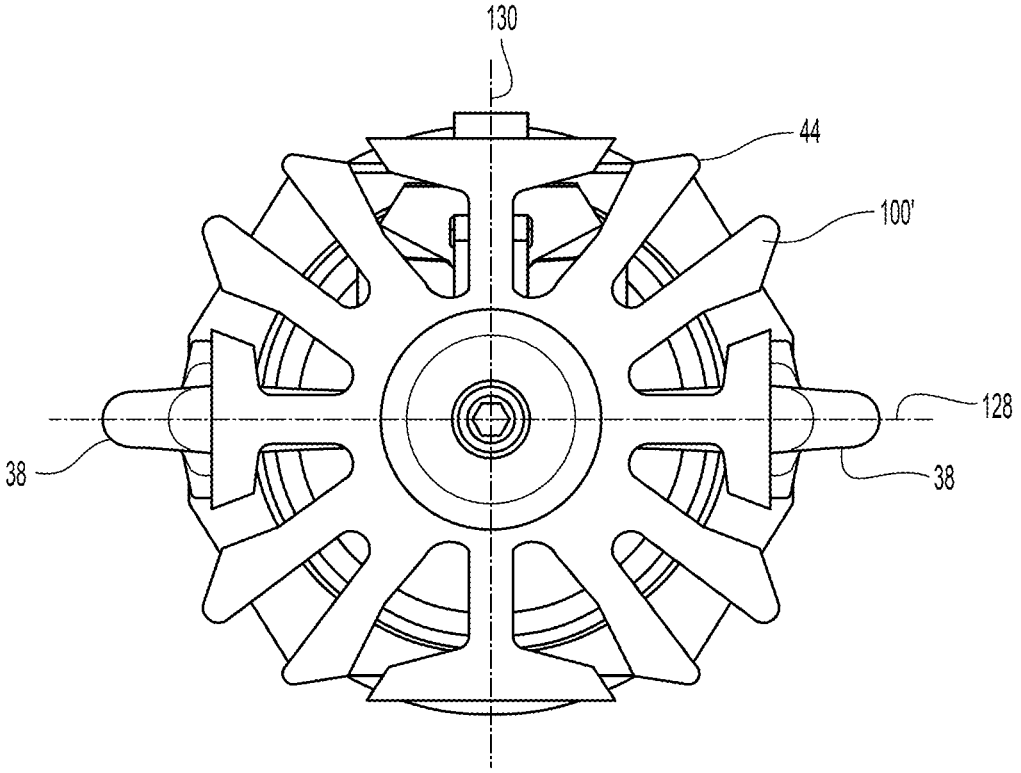
FIG. 3 is a distal end view of the sprinkler assembly of FIG. 1 with a preferred embodiment of a deflector.
Figure 3A:
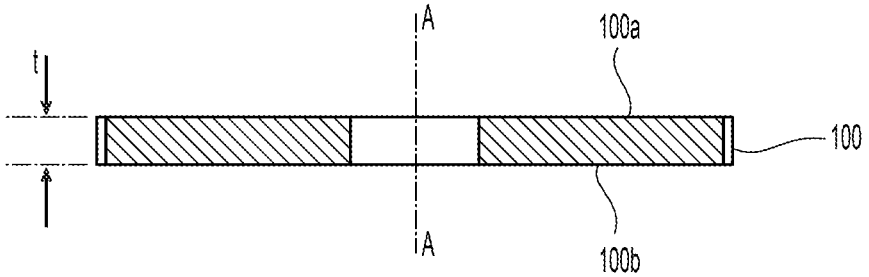
FIG. 3A is a cross-sectional view of the deflector.
Figure 3B:
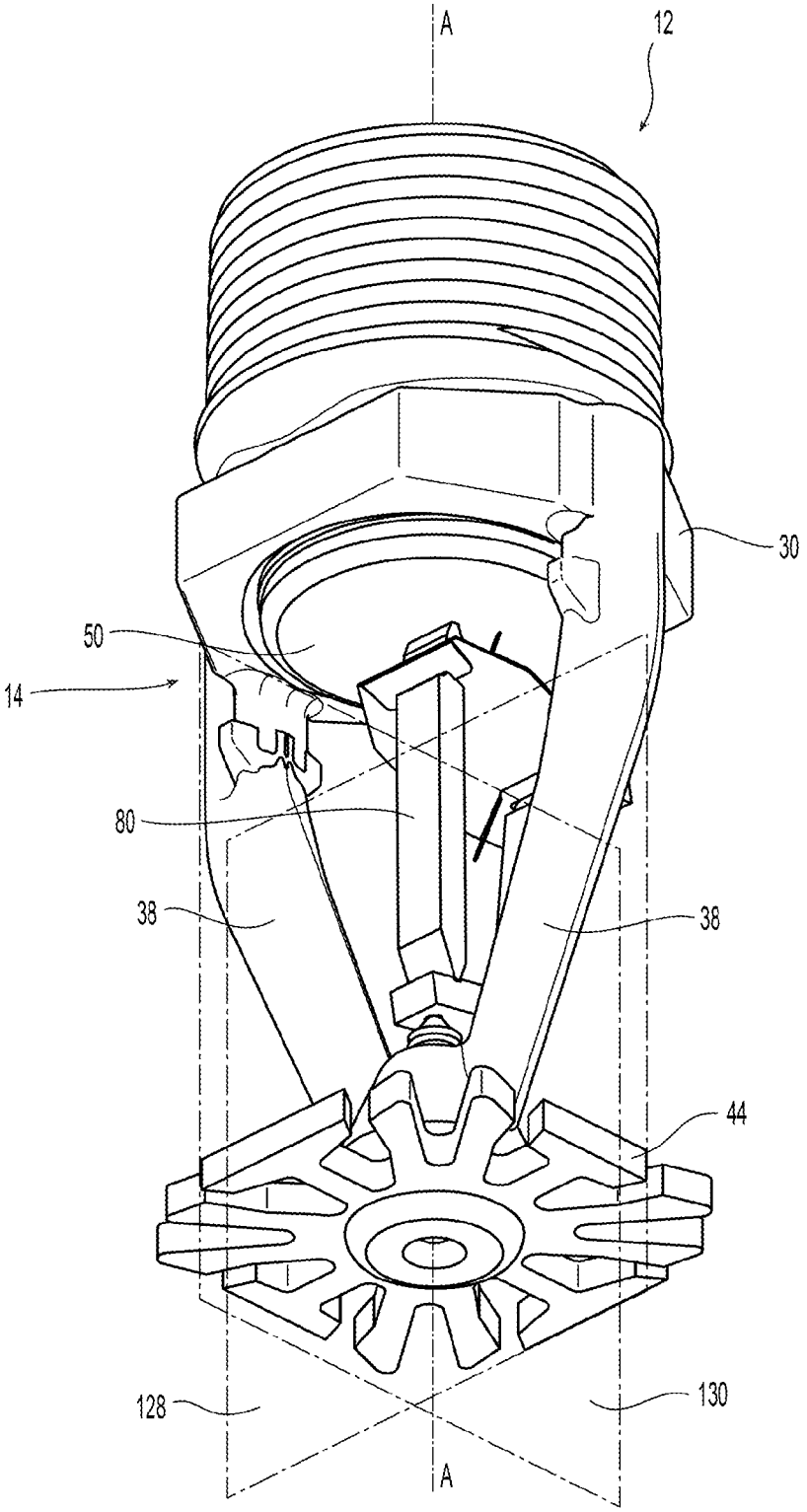
FIGS. 3B-3C are isometric views of the sprinkler assembly of FIG. 3.
Figure 3C:
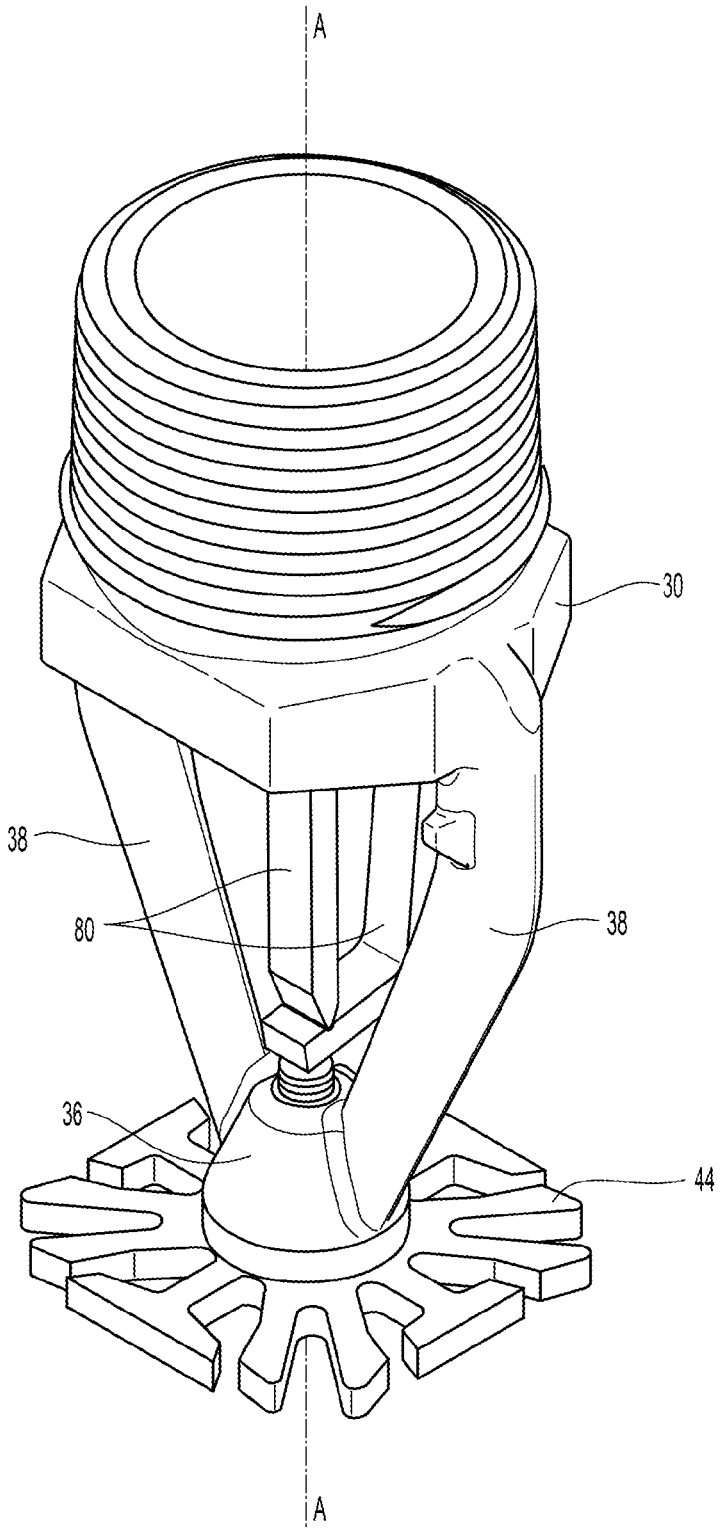

A preferred outlet frame 30 and deflector 100 arrangement is provided for distribution of water for suppression performance, preferably ESFR ("Early Suppression Fast Response") performance. More specifically, the tines and slots are configured and arranged in a manner with respect to the frame arms to provide for the preferred water distribution performance. With reference to FIGS. 3B and 3C, the preferred outlet frame 30 includes two spaced apart arms 38 diametrically opposed about the sprinkler outlet 14 such that the arms 38 are disposed in or define a first plane 128 that includes the sprinkler axis A-A. The arms 38 preferably extend and converge in the distal direction and converge so as to be integrally formed with a frustroconical apex or boss 36 that is axially spaced from the outlet 14.

The preferred deflector 100 is preferably affixed to the outlet frame 30 so as to be axially spaced from the outlet 14. The preferred deflector 100 defines a plurality of tines 112 and more preferably defines a plurality of groups of tines, and even more preferably includes a first group 112*a*, second group 112*b*, third group 112*c* and at least fourth group 112*d* of tines, as seen for example in FIGS. 4A-4C and 5A-5C. In one preferred embodiment, the deflector 100 is mounted distally or beneath the frustroconical boss 36 and oriented so that a first group or pair of tines 112*a* are preferably diametrically opposed about the mounting hole 110 and aligned with or along the first plane 128 and the frame arms 38. The first group of tines 112*a* are preferably symmetrical about the first plane 128 such that the first plane 128 bisects each tine of the first pair 112*a*. In one preferred embodiment, each of the first pair of symmetric tines 112*a* is substantially T-shaped. The deflector 100 and tines 112 preferably include a second group or pair of tines 112*b* that are diametrically opposed about the mounting hole 110 and aligned with a second plane 130 that is perpendicular to the first plane 128. The sprinkler axis A-A defines the intersection of the first and second planes 128, 130. Accordingly, the second group of tines 112*b* are preferably disposed orthogonally to the first pair of tines 112*a*. The second group of tines 112*b* are preferably symmetrical about the second plane 130 such that the second plane 130 bisects each tine of the second pair 112*b*. In one preferred embodiment, each of the second pair of symmetric tines 112*b* is substantially T-shaped. Moreover the deflector is preferably symmetrical about each of the first and second plane 128, 130 to define four similarly configured or identical quadrants of the deflector 100, 100'. In the preferred embodiment, the first and second pair of T-shaped tines 112*a*, 112*b* are disposed in a common plane orthogonal to the sprinkler axis A-A.

In the plan view of the preferred deflector 100 as seen for example in FIGS. 4A-4C, 5A-5C, the second pair of T-shaped tines 112*b* preferably define a larger deflector surface area as compared to the first pair of T-shaped tines 112*a*. The body 120 of the tines 112 can be defined by a first width 134*a* at the base 118, a second width 134*b* between the base and the terminal portion 122 and a third width 134*c* in the terminal portion 122 between the second width 134*b* and the terminal edge 124. Given the shape of the T-shaped tines, the third tine width 134*c* is greater than the first width 134*a* and the second tine widths 134*b*. In preferred embodiments of the deflector and the first pair of T-shaped tines 112*a*, the first width 134*a* and the second with 134*b* are substantially similar and more preferably equivalent. In alternate preferred embodiments of the deflector 100 of FIGS. 4A-4C and the second T-shaped tines 112*b*, the first and second widths 134*a*, 134*b* are different from one another. More preferably in the second T-shaped tine 112*b*, the second width 134*b* is preferably greater than the first width 134*a* in the second pair of T-shaped tines. In an alternate embodiment of the deflector 100', shown in FIGS. 5A-5C, the second T-shaped tines 112*b*, the second width 134*b* and the first width 134*a* are substantially similar and preferably equal or the same. Each of the first width 134*a* and the second widths 134*b* of the T-shaped tines 112 preferably range from about 0.05 inch to about 0.1 inch. For the preferred deflector thickness t of 0.125 inch the deflector 100, 100', the ratio of the first and/or second widths 134*a*, 134*b* to deflector thickness t (width-to-thickness ratio) can preferably ranges from about 0.4 to about 0.8. The inventor discovered that for deflector members made from brass or similarly malleable material, the preferred ratio of width-to-deflector thickness preferably varies directly with K-factors greater than 22 GPM/$(PSI)^{1/2}$ to minimize or eliminate deformation during operational conditions.

The terminal end surfaces 124 of the first and second T-shaped tines 112*a*, 112*b* are planar respectively extending perpendicularly to the first plane 128 and the second plane 130. Preferably, the planar terminal end surface 124*a* of the first T-shaped tine 112*a* present a surface disposed parallel to the second plane 130 and the planar terminal end surface 124*b* of the second T-shaped tines 112*b* is disposed parallel to the second plane 128. Preferably angularly disposed between the first pair of T-shaped tines 112*a* and the second pair of T-shaped tines 112*b*, in a circumferential direction about the sprinkler axis A-A, are a plurality tines and more preferably a third group of tines 112*c* and a fourth group of tines 112*d*. The third and fourth tines 112*c*, 112*d* are preferably asymmetric with respect to any line radially extending from the base 118 to the terminal end portion 122 of the tine 112*c*, 112*d*. The terminal portions 122*c*, 122*d* of the third and fourth tines 112*c*, 112*d* define terminal edges or surfaces 124*c*, 124*d* that are preferably radiused with the center of curvature disposed on the terminal portion 122*c*, 122*d* of the body 120*c*, 120*d* of the tine 112*c*, 112*d*.

The edges or surfaces 124 of the tines 112, whether linear or rounded, collectively define the general perimeter of the deflector such as, for example, a non-circular perimeter. More specifically, the terminal end surfaces 124 of each of the plurality of tines 112 include a tine edge, each of which defines a radial distance from the sprinkler axis. In one aspect, the radial distances of the tine edges vary from the sprinkler axis such that the tine edges can approximate a non-circular perimeter, such as for example, a rectangle, a square, a hexagon, other polygon or oval. In another aspect of the deflector, the terminal edges 124 of each tine 112 can define a preferred maximum perpendicular linear distance relative to one of the first and second planes 128, 130. For example, the terminal edge 124*a* of the first T-shaped tine 112*a* defines a preferred perpendicular linear distance of about 0.8 inches from the second plane 130 and more preferably ranges from a distance of about 0.78 inch to about 0.81 inch from the second plane 130. The terminal edge of 124*b* of the second T-shaped tine 112*b* preferably defines a preferred perpendicular linear distance ranging from about 0.81 inch to about 0.82 inches from the first plane 128 and is more preferably 0.82 inch. Accordingly, the first pair of T-shaped tines 112*a* define a preferred first width W1 of the deflector preferably ranging from about 1.5 inch to about 1.6 inches and more preferably ranging from about 1.55 inches to about 1.65 inches. The second pair of T-shaped tines to define a second width W2 of the deflector ranging from about 1.6 inches to about 1.65 inches and more preferably ranging from about 1.62 inches to about 1.64 inches. In the preferred embodiment, the first pair of T-shaped tines 112*a* define a narrower or smaller width W1 of the deflector 100 as compared to the second width W2 defined by the second pair of T-shaped tines 112*b*. Accordingly, preferred embodiments of the deflector 100, 100' define a ratio of the first-width W1-to-second-width W2 ranging from 0.9 to 1. The inventor has determined that the preferred ratio can provide for desired fluid distributions.

As seen in each of FIGS. 4A-4C, 5A-5C, a pair of third asymmetric tines 112*c* are adjacent and radially disposed about each of the first T-shaped tines 112*a*; a pair of fourth asymmetric tines 112*d* are preferably disposed about each of the second T-shaped tines 112*b*. Each of the terminal edges of the third and fourth asymmetrical tines 112*c*, 112*d* defines a maximum linear distance for the tine 112*c*, 112*d* from one of the first and second planes 128, 130. For example, the radiused terminal edge 124*c* of the third asymmetric tine defines a tangent which is at a preferred maximum perpendicular linear distance ranging from about 0.82 inch to about 0.83 inch from the second plane 130. For the preferred deflector, the terminal edge 124*a* of the first T-shaped tine 112*a* is closer to the second plane 130 than the furthest point or tangent of the third asymmetric tine 112*c* relative to the second plane 130. The radiused terminal edge 124*d* of the fourth asymmetric tine defines a tangent which is a preferred maximum perpendicular linear distance ranging from about 0.76 inch to about 0.77 inch from the first plane 128. Accordingly, for the preferred deflector, the terminal edge 124*b* of the second T-shaped tine 112*b* is further away from the first plane 128 than the furthest point or tangent of the third asymmetric tine 112*c* relative to the first plane 128.

The tines 112 include lateral edges 126 which progress radially outward from the central portion 102 of the deflector. For the preferred T-shaped tines 112*a*, 112*b*, the respective lateral edges 126*a*, 126*b* includes a first portion 126*aa*, 126*ba* which extend one of parallel or skewed relative to the respective first and second plane 128, 130 from the base portion 118 to the terminal portion 122 to define each of the first and second tine widths 134*a*, 134*b* which may be variable or the same as previously described. The lateral edges 126*a*, 126*b* of the preferred T-shaped tines 112*a*, 112*b* further includes a second portion 126*ab*, 126*bb* which extends partially over the terminal portion to 122 to define the preferred third widths 134*c* previously described. In one embodiment of the deflector, the second portion 126*ab* of the lateral edge 126*a* of the first T-shaped tine 112*a* defines a preferred included angle of about 83 degrees with respect to the first plane 128. The second portion 126*bb* of the lateral edge 126*b* of the second T-shaped tine 112*b* defines a preferred included angle of about 81 degrees with respect to the second plane 130. Moreover, the lateral edges 126*a*, 126*b* of the preferably T-shaped tines 112*a*, 112*b* include a third portion 126*ac*, 126*bc* over the terminal portion to 122 to the terminal edge 124 to define an angle with respect to one of the first and second planes 128, 130. For example, the third portion 126*ac* of the first T-shaped tine 112*a* lateral edge 126*a*, defines a preferred included angle of about 21 degrees with respect to the first plane 128. The third portion 126*bc* of the second T-shaped tine 112*b* lateral edge 126*b*, defines a preferred included angle of about 33 degrees with respect to the second plane 130.

The lateral edges of each of the third and fourth tines 112*c*, 112*d* define included angles with respect to one of the first and second planes 128, 130 to define the preferred asymmetric profiles of the tines 112*c*, 112*d*. The third tine 112*c* includes a lateral edge 126*c* having a first portion 126*ca* extending radially from its base 118 radially adjacent the first T-shaped tine 112*a* to define an included of about 36 degrees with respect to the first plane 128. A second portion 126*cb* continuous with the first portion 126*ca* of the lateral edge 126*c* preferably angles toward the first T-shaped tine 112*a* to define an included angle of about 21 degrees with respect to the first plane 128. A third portion 126*cc* continuous with the second portion 126*cb* of the lateral edge 126*c* preferably angles away the first T-shaped tine 112*a* to define an included angle of about 71 degrees with respect to the first plane 128. A fourth portion 126*cd* of the lateral edge 126*c* extends from the base 118 to define the lateral side of the third tine 112*c* opposite the first, second and third portions 126*ca*, 126*cb*, 126*cc* portions of the lateral edge 126*c*. The fourth portion 126*cd* defines a preferred included angle of about 37 degrees with respect to the first plane 128. Formed between the third and fourth portions 126*cc*, 126*cd* is the preferably radiused terminal edge 124*c* of the third tine 112*c*. The terminal edge defines a preferred radius of curvature of about 0.045 inch.

The fourth tine 112*d* includes a lateral edge 126*d* having a first portion 126*da* extending radially from its base 118 radially adjacent the second T-shaped tine 112*b* to define an included angle of about 40 degrees with respect to the second plane 130. A second portion 126*db* continuous with the first portion 126*da* of the lateral edge 126*d* preferably angles toward the second T-shaped tine 112*b* to define an included angle of about 27 degrees with respect to the second plane 130. A third portion 126*dc* continuous with the second portion 126*db* of the lateral edge 126*d* preferably angles away the second T-shaped tine 112*b* to define an included angle of about 81 degrees with respect to the second plane 130. A fourth portion 126*dd* of the lateral edge 126*d* extends from the base 118 to define the lateral side of the fourth tine 112*d* opposite the first, second and third portions 126*da*, 126*db*, 126*dc* of the lateral edge 126*d*. The fourth portion 126*dd* defines a preferred included angle of about 40 degrees with respect to the second plane 130. Formed between the third and fourth portions 126*cc*, 126*d* is the preferably radiused terminal edge 124*d* of the fourth tine 112*d*. The terminal edge defines a preferred radius of curvature of about 0.031 inch.

Preferably, each quarter or quadrant of the deflector defined by the intersection of the first and second planes 128, 130 preferably includes slots of the first, second and third groups 116*a*, 116*b*, 116*c* having a radial innermost portion disposed at different radial distances from the sprinkler axis A-A. The fourth portions 126*cd*, 126*dd* of the lateral edges 126*c*, 126*d* of the third tines 112*c* and fourth tines 112*d* are arranged with respect to planes 128 and 130 so as to define the first group of slots 116*a* aligned at about 45-degree angle relative to the first and second planes 128, 130. Moreover, the lateral edge 126*a* of the first T-shaped tine 112*a* and the first, second and third portions 126*ca*, 126*cb*, 126*cc* portions of the lateral edge 126*c* of the third tine 112*c* define a second group of slots 116*b* therebetween. The lateral edge 126*b* of the second T-shaped tine 112*b* and the first, second and third portions 126*da*, 126*db*, 126*dc* of the lateral edge 126*d* of the fourth tine 112*d* defines a third group of slots 116*c* therebetween.

The divergence of radially adjacent lateral edges can define features of the slots 116*a*, 116*b*, 116*c* over their radial length outward from the central portion 102 to the peripheral portion 104. For example, the first group of slots 116*a* preferably define a slot width that increases in the radial direction from the central portion 102 to the peripheral portion 104. In contrast, each of the second and third group of slots 116*b*, 116*c* have a slot width that varies over its radial length preferably having the slot width initially increasing in the radial direction toward the peripheral portion and then decreasing in the proximate the terminal portion toward the terminal edge.

Moreover, the convergence of radially adjacent lateral edges 126 at or near the base portions 118 of the tines 112 and the central portion 102 define the preferably radiused innermost portions of the slots 116*a*, 116*b*, 116*c*. In one preferred embodiment of the deflector 100, the first slot 116*a* defines a radiused innermost portion defining a radius of curvature of about 0.05 inch; the second slot 116*b* defines a radiused innermost portion defining a radius of curvature of about 0.07 inch; and the third slot 116*c* defines a radiused innermost portion defining a radius of curvature of about 0.08 inch. In another preferred embodiment of the deflector 100', the first slot 116*a* defines a radiused innermost portion defining a radius of curvature of about 0.05 inch; the second slot 116*b* defines a radiused innermost portion defining a radius of curvature of about 0.06 inch; and the third slot 116*c* defines a radiused innermost portion defining a radius of curvature of about 0.07 inch.

Each radiused innermost portion of the slots defines a tangent to a circle circumscribed and centered about the sprinkler axis A-A. In one preferred embodiment of the deflector 100, the radial innermost of the first slot 116*a* defines a tangent 117*a* to a circle having a diameter of about 1.05 inches centered about the sprinkler axis A-A, the radial innermost of the second slot 116*a* defines a tangent 117*b* to a circle having a diameter of about 0.975 inch centered about the sprinkler axis A-A; the radial innermost of the third slot 116*c* defines a tangent 117*c* to a circle having a diameter of about 0.745 inches centered about the sprinkler axis A-A. In the complete sprinkler assembly 10, the tangent 117*c* of the radial innermost portion is preferably axially aligned tangent to or located beneath the apex or boss 36. In another preferred embodiment of the deflector 100', the radial innermost of the first slot 116*a* defines a tangent 117*a* to a circle having a diameter of about 1.11 inches centered about the sprinkler axis A-A, the radial innermost of the second slot 116*a* defines a tangent 117*b* to a circle having a diameter of about 0.950 inch about the sprinkler axis A-A; the radial innermost of the third slot 116*c* defines a tangent 117*c* to a circle having a diameter of about 0.89 inches about the sprinkler axis A-A.

It should be understood that the stated dimensional values and approximations thereof are preferred embodiments. As used herein, the term "about" is understood as within a range of normal tolerance in the art, for example within 2 standard deviations of the mean. "About" can be understood as within 0.05%, or 0.01% of the stated value. Unless otherwise clear from context, all numerical values provided herein are modified by the term about.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following Features of the Invention, and equivalents thereof.

We claim:

1. A sprinkler assembly comprising:

an outlet frame having an inlet, internal passageway defining a sprinkler longitudinal axis, and an outlet to define a nominal K-factor, the frame including a pair of frame arms diametrically opposed about the outlet to define a first plane with the arms and longitudinal axis being disposed in the first plane; and a deflector coupled to the frame arms so as to be axially spaced from the outlet, the deflector being a planar member having an upper surface, and a lower surface opposite the upper surface to define a uniform thickness of the planar member with the upper and lower surfaces being orthogonal to the sprinkler longitudinal axis, the deflector including a central portion and a peripheral portion, the peripheral portion including a plurality of tines disposed about the central portion to define a plurality of slots between the tines, each tine of the plurality of tines including a base extending from the central portion, a body extending from the base, and a terminal portion extending from the body, the terminal portion including a terminal edge radially spaced from the base, the plurality of tines including:

a first symmetric tine aligned with the pair of frame arms, the first symmetric tine being symmetric about the first plane;

a second symmetric tine orthogonal to the first symmetric tine, the second tine being symmetric about a second plane, the second plane being perpendicular to the first plane so as to define an intersection of the first and second planes disposed along the longitudinal sprinkler axis;

a first pair of asymmetric tines disposed about and adjacent the first symmetric tine, the terminal edge of the first symmetric tine being closer to the second plane than the terminal edges of each of the first pair of asymmetric tines, each asymmetric tine being asymmetric with respect to a line extending from the base of the tine through the terminal portion of the asymmetric tine;

wherein the terminal edge of the first symmetric tine is closer to the second plane than the terminal edge of the second symmetric tine is to the first plane; and wherein the first symmetric tine includes a first pair of tines disposed about the central portion to define a first width of the deflector, the second symmetric tine includes a second pair of tines disposed about the central portion to define a second width of the deflector, the deflector defining a first width-to-second width ratio ranging from 0.9 to about 1.

2. The sprinkler assembly of claim 1, wherein the ratio is 0.9.

3. The sprinkler assembly of claim 2, wherein the first width is about 1.5 inches.

4. A sprinkler assembly comprising:

an outlet frame having an inlet, internal passageway defining a sprinkler longitudinal axis, and an outlet to define a nominal K-factor, the frame including a pair of frame arms diametrically opposed about the outlet to define a first plane with the arms and longitudinal axis being disposed in the first plane; and a deflector coupled to the frame arms so as to be axially spaced from the outlet, the deflector being a planar member having an upper surface, and a lower surface opposite the upper surface to define a uniform thickness of the planar member with the upper and lower surfaces being orthogonal to the sprinkler longitudinal axis, the deflector including a central portion and a peripheral portion, the peripheral portion including a plurality of tines disposed about the central portion to define a plurality of slots between the tines, each tine of the plurality of tines including a base extending from the central portion, a body extending from the base, and a terminal portion extending from the body, the terminal portion including a terminal edge radially spaced from the base, the plurality of tines including:

a first symmetric tine aligned with the pair of frame arms, the first symmetric tine being symmetric about the first plane;

a second symmetric tine orthogonal to the first symmetric tine, the second tine being symmetric about a second plane, the second plane being perpendicular to the first plane so as to define an intersection of the first and second planes disposed along the longitudinal sprinkler axis;

a first pair of asymmetric tines disposed about and adjacent the first symmetric tine, the terminal edge of the first symmetric tine being closer to the second plane than the terminal edges of each of the first pair of asymmetric tines; and including a second pair of asymmetric tines disposed about and adjacent the second symmetric tine, the terminal edge of the second symmetric tine being further from the first plane than the terminal edges of each of the second pair of asymmetric tines, each asymmetric tine being asymmetric with respect to a line extending from the base of the asymmetric tine through the terminal portion of the asymmetric tine.

5. The sprinkler assembly of any one of claim 1 or 4, wherein the body of each of the first and second symmetric tines define a first width and a second width of the body between the base and the terminal portion, the first and second widths in the first symmetric tine being the same and the first and second widths in the second symmetric tine being the same.

6. A sprinkler assembly comprising:

an outlet frame having an inlet, internal passageway defining a sprinkler longitudinal axis, and an outlet to define a nominal K-factor, the frame including a pair of frame arms diametrically opposed about the outlet to define a first plane with the arms and longitudinal axis being disposed in the first plane; and a deflector coupled to the frame arms so as to be axially spaced from the outlet, the deflector being a planar member having an upper surface, and a lower surface opposite the upper surface to define a uniform thickness of the planar member with the upper and lower surfaces being orthogonal to the sprinkler longitudinal axis, the deflector including a central portion and a peripheral portion, the peripheral portion including a plurality of tines disposed about the central portion to define a plurality of slots between the tines, each tine of the plurality of tines including a base extending from the central portion, a body extending from the base, and a terminal portion extending from the body, the terminal portion including a terminal edge radially spaced from the base, the plurality of tines including:

a first symmetric tine aligned with the pair of frame arms, the first symmetric tine being symmetric about the first plane;

a second symmetric tine orthogonal to the first symmetric tine, the second tine being symmetric about a second plane, the second plane being perpendicular to the first plane so as to define an intersection of the first and second planes disposed along the longitudinal sprinkler axis; and a first pair of asymmetric tines disposed about and adjacent the first symmetric tine, the terminal edge of the first symmetric tine being closer to the second plane than the terminal edges of each of the first pair of asymmetric tines, wherein the body of each of the first and second symmetric tines defines a first width of the body and a second width of the body between the base and the terminal portion, the first and second widths in the first symmetric tine being the same and the first and second widths in the second symmetric tine being different, each asymmetric tine being asymmetric with respect to a line extending from the base of the asymmetric tine through the terminal portion of the asymmetric tine.

7. A sprinkler assembly comprising:

an outlet frame having an inlet, internal passageway defining a sprinkler longitudinal axis, and an outlet to define a nominal K-factor, the frame including a pair of frame arms diametrically opposed about the outlet to define a first plane with the arms and longitudinal axis being disposed in the first plane; and a deflector coupled to the frame arms so as to be axially spaced from the outlet, the deflector being a planar member having an upper surface, and a lower surface opposite the upper surface to define a uniform thickness of the planar member with the upper and lower surfaces being orthogonal to the sprinkler longitudinal axis, the deflector including a central portion and a peripheral portion, the peripheral portion including a plurality of tines disposed about the central portion to define a plurality of slots between the tines, each tine of the plurality of tines including a base extending from the central portion, a body extending from the base, and a terminal portion extending from the body, the terminal portion including a terminal edge radially spaced from the base, the plurality of tines including:

a first symmetric tine aligned with the pair of frame arms, the first symmetric tine being symmetric about the first plane;

a second symmetric tine orthogonal to the first symmetric tine, the second tine being symmetric about a second plane, the second plane being perpendicular to the first plane so as to define an intersection of the first and second planes disposed along the longitudinal sprinkler axis;

a first pair of asymmetric tines disposed about and adjacent the first symmetric tine, the terminal edge of the first symmetric tine being closer to the second plane than the terminal edges of each of the first pair of asymmetric tines, each asymmetric tine being asymmetric with respect to a line extending from the base of the tine through the terminal portion of the asymmetric tine; and wherein the first symmetric tine is defined by a lateral edge extending from the base to the terminal edge, the lateral edge including a first portion extending parallel to the first plane to define a first width and a second width being the same as the first width, a second portion continuous with the first portion to define a first included angle with the first plane to define a third width greater than the first and second widths, a third portion continuous with the second portion and extending to the terminal edge to define a second included angle with the first plane being less than the first included angle.

8. The sprinkler assembly of claim 7, wherein the first width defines a width-to-thickness ratio ranging from about 0.4 to about 0.8.

9. The sprinkler assembly of claim 7, wherein the second symmetric tine is defined by a lateral edge extending from the base to the terminal edge, the lateral edge including a first portion extending parallel to the second plane to define a first width and a second width being the same as the first width, a second portion continuous with the first portion to define a first included angle with the second plane to define a third width greater than the first and second widths, a third portion continuous with the second portion and extending to the terminal edge to define a second included angle with the second plane being less than the first included angle.

10. The sprinkler assembly of claim 7, wherein the second symmetric tine is defined by a lateral edge extending from the base to the terminal edge, the lateral edge including a first portion extending skewed to the second plane to define a first width and a second width being different than the first width, a second portion continuous with the first portion to define a first included angle with the second plane to define a third width greater than the first and second widths, a third portion continuous with the second portion and extending to the terminal edge to define a second included angle with the second plane being less than the first included angle.

11. The sprinkler assembly of claim 7, wherein each of the first pair of asymmetric tines is defined by a lateral edge extending from the base to the terminal edge, the lateral edge including a first portion extending to define a first included angle with the first plane; a second portion continuous with the first portion extending toward the first symmetric tine to define a second included angle with the first plane that is less than the first included angle; a third portion continuous with the second portion extending away from the first symmetric tine to define a third included angle with the first plane being greater than the second included angle; and a fourth portion extending from the base opposite the first, second and third portions about the asymmetric tine to define a fourth included angle which is about the same as the first included angle.

12. The sprinkler assembly of claim 7, further comprising a second pair of asymmetric tines disposed about and adjacent the second symmetric tine wherein each of the second pair of asymmetric tines is defined by a lateral edge extending from the base to the terminal edge, the lateral edge including a first portion extending to define a first included angle with the first plane; a second portion continuous with the first portion extending toward the first symmetric tine to define a second included angle with the first plane that is less than the first included angle; a third portion continuous with the second portion extending away from the first symmetric tine to define a third included angle with the first plane being greater than the second included angle; and a fourth portion extending from the base opposite the first, second and third portions about the asymmetric tine to define a fourth included angle which is about the same as the first included angle.

13. The sprinkler assembly of claim 12, wherein the pair of frame arms extend distally and converge at a boss axially spaced from the outlet, a tine of the first pair of asymmetric tines and a tine of the second pair of asymmetric tines are adjacent to define a first slot therebetween, the tine of the first asymmetric pair and the first symmetric tine defining a second slot therebetween, the tine of the second asymmetric pair and the second symmetric tine defining a third slot therebetween, each of the slots including a radiused and radially innermost portion that defines a tangent to a circle with a diameter centered about the sprinkler longitudinal axis, the tangent of the first slot defining a diameter greater than the diameters defined by the tangents of the second and third slots, the circle of the tangent of the third slot being circumscribed by the circles of the tangents of the first and second slots, such that the tangent of the third slot is axially aligned beneath or tangent to the boss.

14. The sprinkler assembly of claim 8, wherein the K-Factor is greater than 22 GPM/$(PSI)^{1/2}$ and the width-to-thickness ratio is 0.8.

15. The sprinkler assembly of any one of claim 1, 4, 6, or 7, wherein the first and second symmetric tines are T shaped, the terminal edge of the first and second symmetric tines being linear such that the terminal edge of the first symmetrical tine extends perpendicularly to the first plane and parallel to the second plane, the terminal edge of the second symmetrical tine extends perpendicularly to the second plane and parallel to the first plane.

* * * * *